US005383756A

United States Patent [19]

Coleman et al.

[11] Patent Number: 5,383,756

[45] Date of Patent: Jan. 24, 1995

[54] CASSETTE FOR BINDING STRIPS

[75] Inventors: John E. Coleman, Reno; Barney A. Tipps, Sparks, both of Nev.; Peter Hotowski, Deep River, Conn.

[73] Assignee: VeloBind, Inc., Northbrook, Ill.

[21] Appl. No.: 197,003

[22] Filed: Feb. 15, 1994

Related U.S. Application Data

[63] Continuation of Ser. No. 975,460, Nov. 12, 1992, abandoned.

[51] Int. Cl.[6] ..... B42B 9/00

[52] U.S. Cl. ..... 412/38; 412/9; 412/41; 206/338; 206/509

[58] Field of Search ..... 412/9, 33, 38, 40, 41, 412/43; 206/338, 340, 509, 511; 221/69, 82

[56] References Cited

U.S. PATENT DOCUMENTS

| | | | |
|---|---|---|---|
| 3,842,982 | 10/1974 | Joyce | 206/509 X |
| 4,369,013 | 1/1983 | Abildgaard | 412/38 |
| 4,674,906 | 6/1987 | Abildgaard | 402/80 |
| 4,844,647 | 7/1989 | Tipps | 412/33 |
| 4,846,616 | 7/1989 | Abildgaard | 412/7 |
| 4,940,156 | 7/1990 | Cote et al. | 206/509 X |
| 5,017,071 | 5/1991 | Todaro | 412/43 |
| 5,142,445 | 8/1992 | Sorensen et al. | 206/509 X |

*Primary Examiner*—Mark Rosenbaum
*Assistant Examiner*—S. Thomas Hughes
*Attorney, Agent, or Firm*—Julian Caplan

[57] ABSTRACT

For convenient packaging of plastic bookbinding strips, cassettes which may be securely stacked one upon the other are provided. The end edges of each strip are received in channels formed in opposed side rails. The rails are attached to transverse spacer bars which are preferably detachably connected to the side rails and are interchangeable to accommodate strips of different lengths-e.g., 8½ inches, 11 inches, etc. Cassettes may be securely stacked one upon the other by means of mating stacking struts extending upward and downward from the side rails. Very short stacking struts may be used when packaging flat female binding strips in the cassette. A detent is provided in the ends of the rails preventing removal of strips until the detent is bent out of position. The cassette is especially useful in equipment which mechanically assembles punched sheets and strips preparatory to binding a book in a binding machine. Projections from the side rails may be used by such equipment to guide and center the cassettes within the machine.

6 Claims, 5 Drawing Sheets

CASSETTE FOR BINDING STRIPS

This is a continuation of application Ser. No. 07/975,460, filed Nov. 12, 1992 now abandoned.

BACKGROUND OF THE INVENTION

1. Field of the Invention

This invention relates to a cassette of the type disclosed in U.S. Pat. No. 4,844,647, for packaging bookbinding strips of the type shown in FIG. 1 of U.S. Pat. No. 4,369,013, and in U.S. Pat. No. 4,674,906. A cassette may be used in equipment for binding books wherein the binding strips are mechanically fed into the equipment preparatory to binding by means of equipment such as that shown in U.S. Pat. No. 4,846,616 and U.S. Pat. No. 5,017,071. Strips may also be removed from the cassette for manual insertion into other bookbinding equipment. The cassette hereinafter described is constructed to ensure secure stacking of cassettes while taking up a minimum of volume during shipping, handling and storage.

2. Description of the Related Art

The cassette hereinafter described is constructed so as to package a plurality of strips such as those heretofore described, such strips being a well-known means for binding books and documents. Heretofore such strips have been commercially packaged in boxes or packaged in cassettes so that they may be automatically fed into proper position for assembly of a book or a document preparatory to binding same. The strips are arranged in side-by-side relationship and discharged from one end of the cassette into receiving means for transfer into a position whereby they may be assembled with punched sheets of paper so that the completed document or book may be bound. The present invention improves the structure of a cassette of the type described in U.S. Pat. No. 4,844,647 by considerably reducing the volume such cassettes take up when stacked for shipping or storage, or in the automatic binding machine, while considerably improving the stability and rigidity of columns of said stacked cassettes.

SUMMARY OF INVENTION

Binding strips of the type shown in U.S. Pat. No. 4,369,013 or U.S. Pat. No. 4,674,906 comprise a set of two strips. The first strip is formed of narrow thermoplastic material and has integral studs projecting therefrom at spaced intervals. The length of the strips may be varied to accommodate different widths of paper and the stud lengths are variable to accommodate different thicknesses of books or documents. The studs may be rigid or may be bendable at right angles. The second strip of the set is flat and narrow and has holes spaced at the same intervals as the studs. Again, the length of the strip may be variable and the hole spacing is variable to accommodate the studs of the first strip.

Such strips have been packaged in cassettes of the type shown in U.S. Pat. No. 4,844,647 so that they are more conveniently available for insertion in a bookbinding machine and, indeed, may be automatically discharged from the cassette and transported into proper position for assembly of a book or document prior to the binding thereof. These cassettes are intended for use in equipment which automatically advances strips longitudinally of the cassette, such as that shown in U.S. Pat. No. 4,846,616 or U.S. Pat. No. 5,017,071. The structure of these cassettes is such that it provides no obstructions to the portion of such equipment which engages the strips to so advance the same.

Prior cassettes are somewhat unwieldy and take up considerable space when stacked. Also, cassettes stacked in this manner may be upset when moved or installed in the binding machine, or when shifting occurs during shipping. For example, cassettes of the type described in U.S. Pat. No. 4,844,647 may take up more volume than necessary because the spacer bars used in that invention are situated above the level of the side rails, held by legs which extended up from the side rails so that the spacer bars are well above the level of the tops of the studs formed on the strips. This was done so that when stacked, downward projections from the side rails of one cassette could rest upon the spacer bars of an underlying cassette. This configuration is not as sturdy or desirable, especially when several cassettes are stacked one upon the other as is the configuration of the present invention.

One feature of the current invention reduces the volume and improves the stability of the cassette by connecting the spacer bars directly to, and at approximately the same level as the side rails. Having the bracing provided by the spacer bars located near the bottom of the cassette, closer to the plane of the side rails, improves the stability of the cassette. Also, removing the bracing from the top of the cassettes and adding it to the bottom of the cassettes allows studs of the male strips in a cassette to extend almost to the bottom of the cassette stacked on top of it, thus reducing the volume taken up by stacked cassettes by 30%–40%. Thus, considerable economy in the storage and shipping of the cassettes is achieved.

Another of the features of this invention is that mating stacking struts extending upward and downward from the side mils have been added to the cassettes allowing stable, secure stacking of the cassettes.

Other features of the present invention will become apparent upon reading the following specification and referring to the accompanying drawings in which similar characters of reference represent corresponding parts in each of the several views.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 13-A is an enlarged fragmentary sectional view taken substantially along the line 13-A—13-A of FIG. 13.

DETAILED DESCRIPTION OF THE PREFERRED EMBODIMENTS

Figure 1:
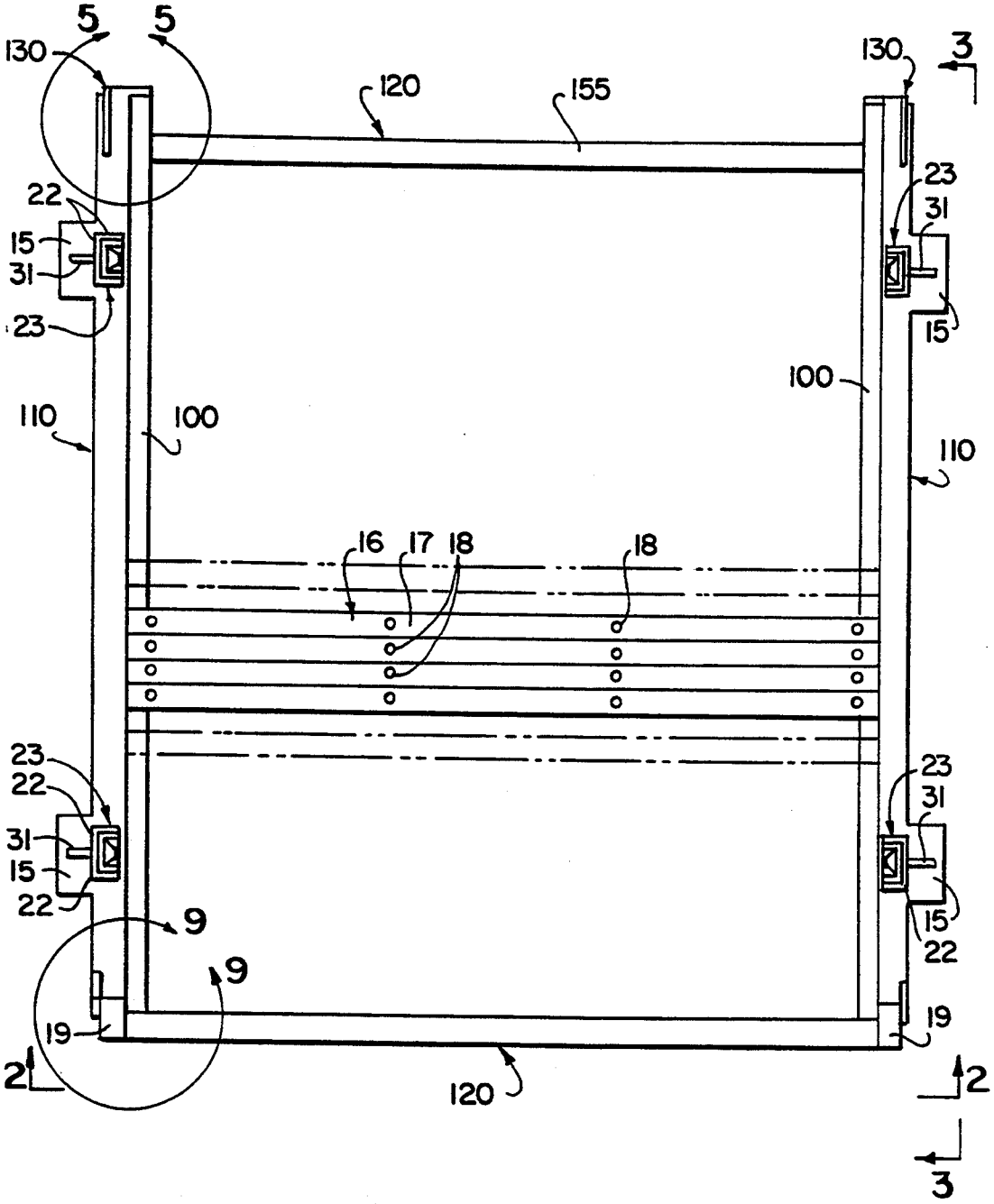
FIG. 1 is a top plan view of a cassette in accordance with the present invention, including several male bookbinding strips loaded within it.
Figure 2:
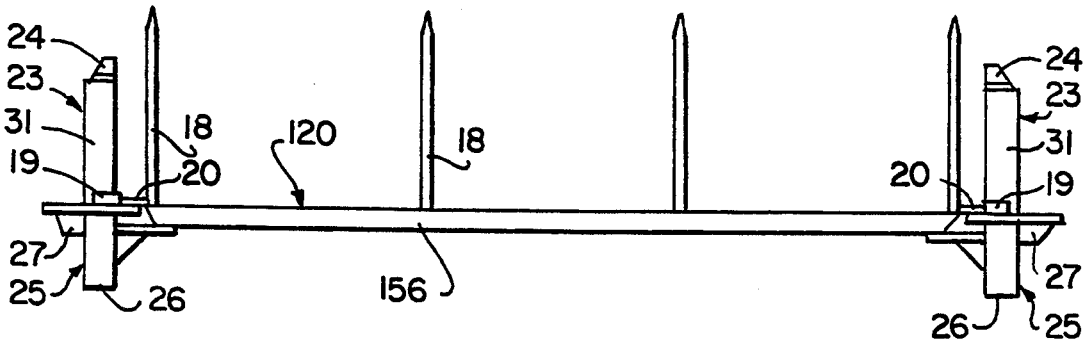
FIG. 2 is an end elevational view of the structure of FIG. 1, taken substantially along the line 2—2 of FIG. 1.

The cassette hereinafter described in detail is used to package bookbinding strips. Strips 16 shown in FIG. 1 and FIG. 2 have a base 17 which is a thin narrow elongated strip of thermoplastic material from which project integral studs 18 in the case of male strips, or, in the case of female strips, holes are found at intervals spaced the same distances as the studs 18. Such strips are described in detail in U.S. Pat. No. 4,369,013 or U.S. Pat. No. 4,674,906.

On either side of the cassette are side rails 110 which are of a length to accommodate a plurality of strips 16. Extending the entire length of each side rail 110 are upper 20 and lower 100 longitudinal guides, between which is an inward facing channel 50 having the width of the thickness of base 17 and deep enough to receive the ends of strips 16.

Figure 7:
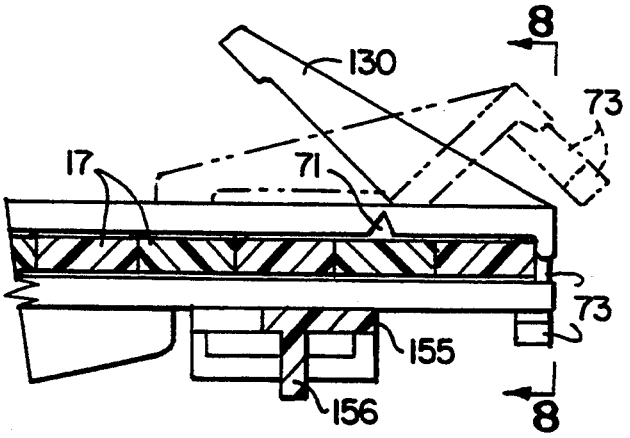
FIG. 7 is a fragmentary sectional view taken substantially along the line 7—7 of FIG. 5, and showing a detent which is removed at the time strips are discharged from the cassette.
Figure 9:
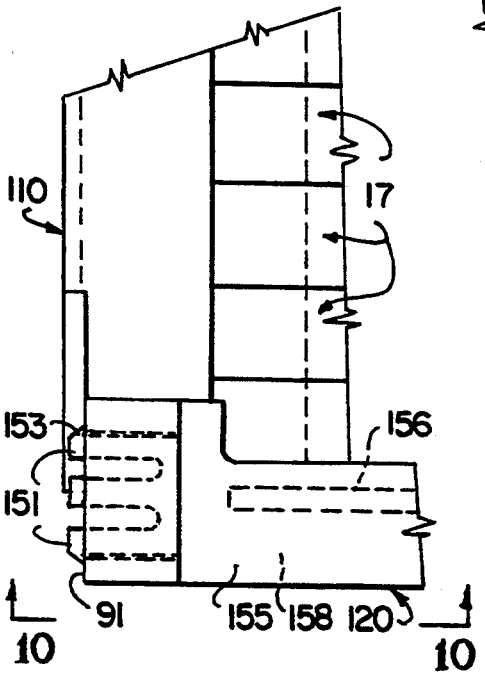
FIG. 9 is an enlarged fragmentary top view similar to FIG. 5 showing substantially the area bounded by the arc 9—9 of FIG. 1.
Figure 8:
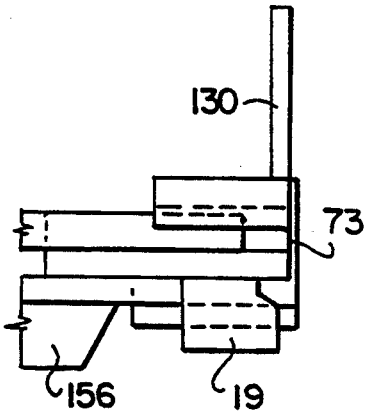
FIG. 8 is a fragmentary end view taken substantially along the line 8—8 of FIG. 7.
Figure 10:
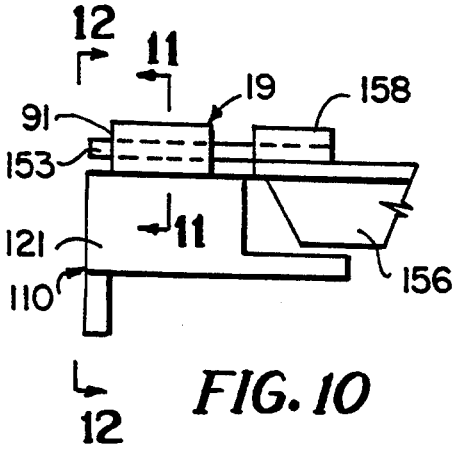
FIG. 10 is a fragmentary end view taken substantially along the line 10—10 of FIG. 9.
Figure 11:
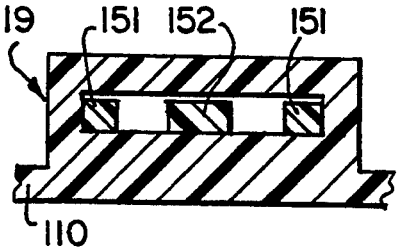
FIG. 11 is an enlarged fragmentary sectional view taken substantially along the line 11—11 of FIG. 10.

As best shown in FIG. 7, a slot 71 is formed in one end of each side rail 110 and a retainer detent 73 prevents strips 16 from being forced out of the channels 50. Such detent 73 closes off the end of channel 50. A lever 130 connected to the side rail 110 above the slot 71 may be bent from the solid line position of FIG. 7 to the dot and dash line position, thereby bending the detent 73 out of the way of channel 50 and permitting the strips 16 to be discharged from the channels 50. It will be understood that when the cassettes are used in automatic machinery, when the cassette is inserted into the machine, an abutment (not shown) contacts the lever 130 and bends it down to the dot and dash line position of FIG. 7 so that the strips 16 may be fed out of the cassette for assembly with perforated sheets to be bound.

Figure 12:
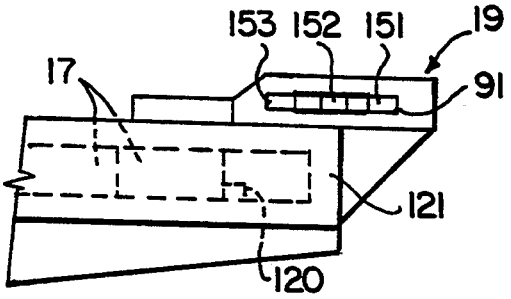
FIG. 12 is a fragmentary side view taken substantially along the line 12—12 of FIG. 10.

To load the cassette, the detent 73 is moved aside so that the strips 16 may be slid into the opposed channels. The end of each channel 50 opposite detent 73 is blocked by a permanent stop 120 which prevents of strips 16 from falling out of the back end of the cassette. This is illustrated in FIG. 12. As an option, the solid wall 121 at the end of the channel may be used for that purpose instead of stop 120.

Figure 13:
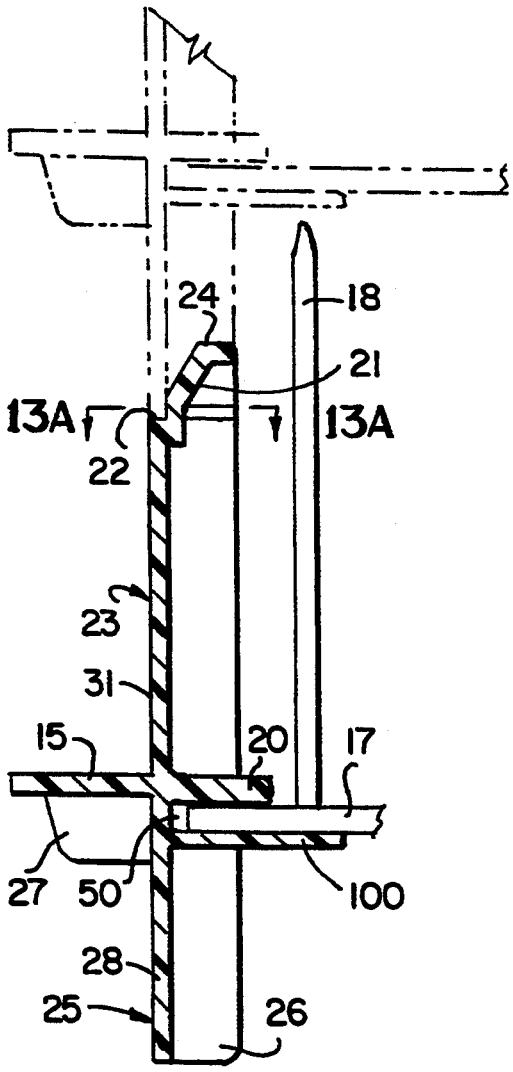
FIG. 13 is a fragmentary sectional view taken substantially along the line 13—13 of FIG. 3.
Figure 13A:
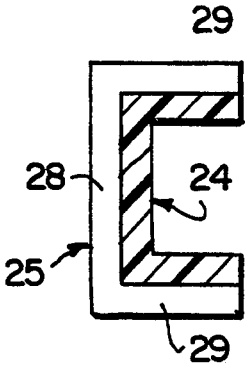
Figure 14:
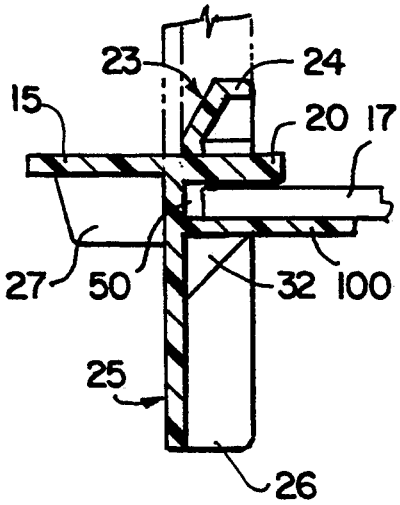
FIG. 14 is a fragmentary sectional view taken substantially along the line 14—14 of FIG. 4.

At locations spaced inward but adjacent to the ends of side rails 110, and integral with side rails 110, are upward projecting stacking struts 23 and downward projecting stacking struts 25, shown enlarged in FIGS. 13 and 14. At the respective ends of these upward projecting stacking struts 23 and downward projecting stacking struts 25 are mating stacking means 24 and 26.

In the preferred embodiment, these stacking means 24 and 26 are upward projections 24 and stacking channels 26, as illustrated most clearly in FIGS. 13, 13-A and 14. Stacking channels 26 are formed by downward projecting stacking struts 25 comprising of a web 28 and two flanges 29, such that corresponding projections 24 fit snugly within each stacking channel 26, as illustrated in FIG. 13-A. When strips 16 of a male type are to be packaged the portion of the upward projecting stacking struts 23 beneath upward projections 24 provides protruding shoulders 22 upon which web 28 and flanges 29 of downward projecting stacking struts 25 may rest. Slanted tops 21 are also located on upward projections 24 to help in guiding downward projecting stacking struts 25 into place.

Figure 3:
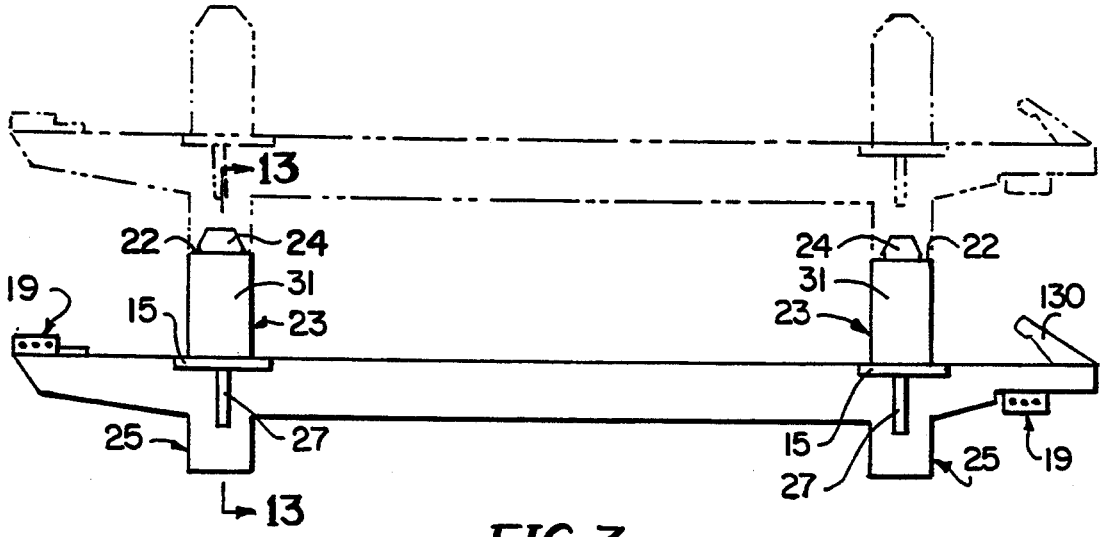
FIG. 3 is a side view of a cassette for male strips taken substantially along the line 3—3 of FIG. 1, and showing in dot and dash lines a second cassette stacked upon the first.

It will be understood that other types or combinations of mating stacking means may be used, so long as the stacking means 24 atop each upward projecting stacking strut 23 mates with the stacking means 26 at the bottom of the downward projecting stacking strut 25 of the cassette directly above it, as illustrated in FIGS. 3, 13 and 13-A.

For ease of manufacture and use, it is preferable for all the upward projecting stacking struts 23 have stacking means 24 of one type and all the downward projecting stacking struts 25 to have stacking means 26 of a corresponding mating type, but it will be understood that other combinations may be used as well.

In the preferred embodiment, the distance between the top end of an upward projecting stacking strut 23 and the bottom end of the downward projecting stacking strut 25 directly beneath it is only slightly greater than the height of the strips 16 being packaged, from base 17 to top of studs 18. This allows enough room for studs 18 when strips 16 of a male type are packaged and the cassettes stacked one atop the other, as illustrated in FIG. 13.

Figure 4:
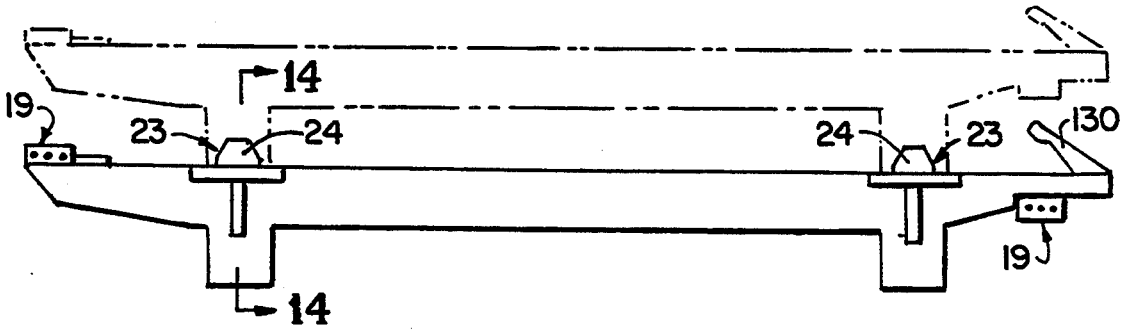
FIG. 4 is similar to FIG. 3, but as configured when used to package flat female strips.
Figure 5:
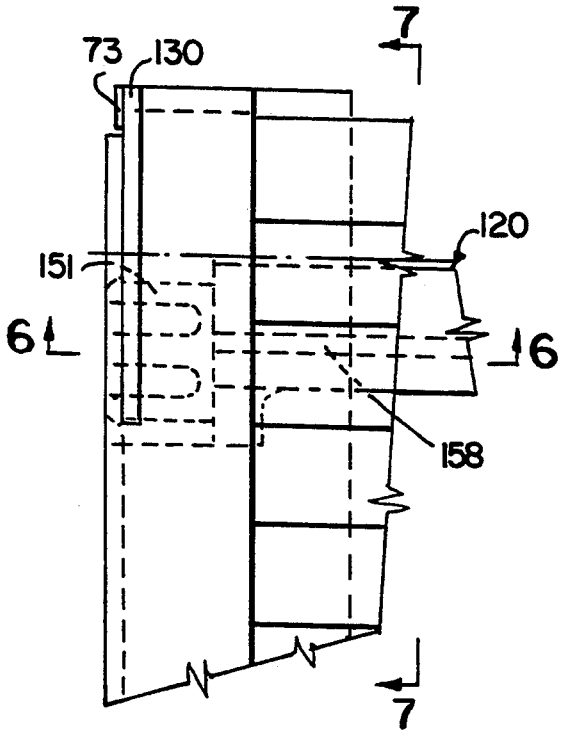
FIG. 5 is an enlarged fragmentary top view showing substantially the area bounded by the are 5—5 of FIG. 1 and showing in dot and dash lines obscured features including connector means connecting spacer bars to side rails.
Figure 6:
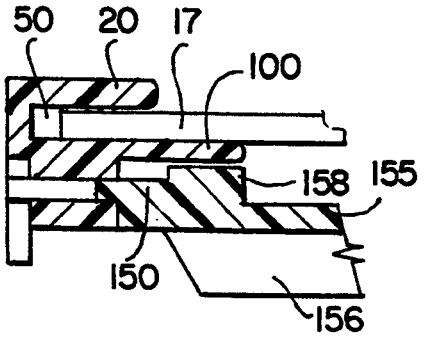
FIG. 6 is a fragmentary sectional view taken substantially along the line 6—6 of FIG. 5.

The length of the downward projecting stacking struts 25 are designed such that when strips 16 of a female type are packaged, the length of the upward projecting stacking struts 23 needed is a minimum, so that the upward projecting stacking struts 23 consist substantially of just the corresponding stacking means 24, as illustrated in FIG. 4.

Gussets 32 extend from lower guide 100 to downward projecting stacking struts 25 in the cassette for female strips shown in FIG. 14 to prevent channel 50 from closing from shrinkage when cooling after molding.

To prevent struts 23 from bending from shrinkage when cooling after molding, gussets 31 are formed on the outer surfaces of struts 23, tapering upwardly.

Figure 15:
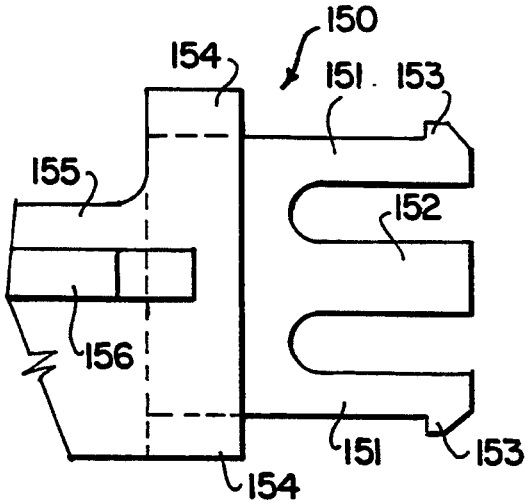
FIG. 15 is an enlarged bottom view of the prong assembly used in the preferred embodiment at the two ends of each spacer bar.

Extending transversely of the cassette adjacent but spaced inward of either end of side rail 110 is a spacer bar 120. Spacer bar 120 has in the preferred embodiment a flat thermoplastic base 155 and, positioned perpendicular to the base 155 and extending longitudinally along the base 155 almost but not quite to the ends of the spacer bar 120, a flat thermoplastic rib 156. The rib 156 may be located centrally along the spacer bar base 155, but it is not necessary that this be so. In the present embodiment, rib 156 is located closer to one side of the base 155 than on the other, as shown in FIG. 15.

Rib 156 gives added stability to spacer bar 120, and in the preferred embodiment serves the added function of supporting base 17 of strip 16 at the end of the cassette opposite that from which strips 16 are fed. In the preferred embodiment, this is accomplished by placing side rail connecting means 19 somewhat above channel 50 and near the end of the cassette opposite that from which strips 16 are fed. This arrangement is illustrated best in FIGS. 2.9, 10 and 12. At the opposite end of the cassette, the end from which strips 16 are fed, side rail connecting means 19 are placed somewhat below channel 50 so that rib 156 does not impede strips 16 as they are fed from the cassette.

The spacer bar 120 has at each end connector means 150 for connecting with side rail 110. In the preferred embodiment this connector means 150 comprises a prong assembly 150 with three prongs, the outer two 151 of which are flexible and are equipped with outward facing tangs 153 at their distal ends. The two outer prongs 151 bend inward as the prong assembly 150 is pushed into a cooperable socket 19 in a side rail 110, and spring outward once the tangs 153 have passed a shoulder 91 integral with said socket 19, at which time the tangs 153 engage the socket shoulder 91 and thus secure the spacer bar 120 from pulling out. The center prong 152 is designed to provide rigidity to the prong assembly 150 and to keep the outer prongs 15 1 from breaking or being otherwise damaged by limiting their bending too far inward. Shoulders 154 extend on either side of the prong assembly 150 at its proximal end to keep the prong assembly 150 from moving farther into the socket and thereby accurately spacing the opposed rails 119 apart. Pads 158 on base 155 of spacer bar 120 help to prevent the weight of strips 17 from causing strut 23 to bend upward.

Extending transversely of the cassette adjacent but spaced inward of either end of each side rail 110 is the connector means 19 for connecting the side rail 110 with a spacer bar 120. This connector means 19 is designed to be cooperable with connector means 150 belonging to spacer bar 120, so that the spacer bar 120 may connect firmly with the side rail 110.

In the preferred embodiment this connector means is a socket 19 that the prong assembly 150 of the spacer bar 120 can be guided into, and also includes a shoulder 91 to catch tangs 153 of the outer prongs 151 and so secure the spacer bar 120 from pulling out. In the preferred embodiment sockets 19 are located at opposite ends of the cassette, either near the top or near the bottom of side rail 110, as discussed above.

As is best illustrated in FIGS. 9–12, in the current embodiment of the invention the socket 19 is a hollow rectangle, its walls converging. The prong assembly 150 of the spacer bar 120 is pushed into the inner opening of the socket 19, its outer prongs 151 being pressed inward by the converging walls as they approach the outer opening. The shoulder 91 in this case is the wall of the outer opening of the socket 19, so that as the tangs 153 of the outer prongs 15 1 clear the outer opening of the socket 19 they spring outward, thus securing the spacer bar 120 from pulling away from the side rail 110.

It is anticipated that many other cooperable means may be used to secure the spacer bar to the side rail 110. An advantage of letting the tangs 153 protrude from the outer opening of the socket 19 as in the preferred embodiment is that the tangs 153 may be squeezed together so that the spacer bar 120 may be easily withdrawn from the socket 19 and exchanged with spacer bars 120 of differing lengths, for use with strips 16 of corresponding lengths.

In the preferred embodiment of this invention, outward extending ears 15 are located on each of side rails 110, whereby the cassette may be guided and positioned correctly within a bookbinding machine. A rib 27 is positioned beneath each ear 15, integral with and perpendicular to the ear 15 and the side rail 110. Rib 27 provides support and stability for the ear 15.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A cassette for bookbinding strips, said cassette comprising parallel first and second side rails each formed with an inward facing channel shaped to receive an end of each of a plurality of thin, narrow strips, each said side rail having integral, longitudinally spaced apart first and second stacking struts, each said first and second stacking strut extending substantially vertically upward from its respective side rail, said first stacking strut having first stacking means on its distal end thereof, said second stacking strut having second stacking means on its distal end thereof, and each said side rail having an integral third and fourth stacking strut, each said third and fourth stacking strut extending substantially vertically downward from said its respective rail and being vertically aligned with said first and second stacking struts, respectively, said third stacking strut having on its distal end thereof third stacking means complementary to said first stacking means, said fourth stacking strut having on its distal end thereof fourth stacking means complementary to said second stacking means, and first and second spacer bars extending horizontally between said first and second side rails, detachably attached adjacent opposing ends of said first and second side rails approximately level with said first and second side rails, whereby a plurality of bookbinding strips may be packaged side by side transverse to said side rails with opposed ends of said strips received in opposed channels, and whereby one cassette may be stacked upon an identical, underlying cassette by placing said third and fourth stacking struts of said cassette with corresponding said third and fourth stacking means upon said first and second stacking struts of said underlying cassette having corresponding said first and second stacking means, said first and second side rails, and said first and second spacer bars each is initially discrete, said cassette having a substantially open and unobstructed top and a substantially open and unobstructed bottom.

2. A cassette according to claim 1, in which said first and second stacking means each comprise an upward projection which has a first U-shaped cross section, and said third and fourth stacking means each comprise a downward projection which has a second U-shaped cross section, said first and third projections nesting inside each other, said second and fourth projections nesting inside each other.

3. A cassette according to claim 1, further comprising first connector means on each end of each of said spacer bars and second connector means on each said side rail to engage said first connector means, in order to secure said spacer bars to said side rails, said first connector means comprising a prong assembly comprising at least one flexible prongs having a tang, said second connector means comprising a socket into which said prong assembly may be inserted, said socket having a shoulder beyond which said tang may catch after insertion, whereby said first connector means may be secured within said second connector means.

4. A cassette according to claim 1 in which said first and second spacer bars are interchangeable with spacer bars of different lengths so that the width of said cassette may be varied to accommodate bookbinding strips having different lengths.

5. A cassette for bookbinding strips, said cassette comprising parallel opposed horizontal side rails each formed with an inward facing horizontal channel shaped to receive the ends of a plurality of thin, narrow strips, each said side rail having a plurality of spaced connectors each having first connector means, and at least two spacer bars disposed transverse to said side rails, each said bar having on opposite ends thereof two spaced second connector means cooperable with said first connector means to secure said spacer bars to said side rails such that said side rails are held parallel and fixed a selected distance apart, whereby a plurality of bookbinding strips may be packaged side by side transverse to said side rails with opposed ends received in opposed channels, wherein the improvement comprises, first and second stacking struts integral with each said side rail, each said first and second stacking strut extending substantially vertically upward from said its respective rail, said first stacking strut having first stacking means on its distal end thereof, and said second stacking strut having second stacking means on its distal end thereof, and third and fourth stacking struts integral with each said side rail, each said third and fourth stacking strut extending substantially vertically downward from its respective side rail and being vertically aligned with said first and second stacking struts, respectively, said third stacking strut having on its distal end thereof third stacking means complementary to said first stacking means, and said fourth stacking strut having on its distal end thereof fourth stacking means complementary to said second stacking means, whereby one cassette may be stacked upon an identical, underlying cassette by placing said third and fourth stacking struts of said cassette with corresponding said third and fourth stacking means upon said first and second stacking struts of said underlying cassette having corresponding said first and second stacking means, said first and second side rails, and first and second spacer bars each being initially discrete, said cassette having a substantially open and unobstructed top and a substantially open and unobstructed bottom.

6. A cassette according to claim 5 in which said improvement further comprises said first and second spacer bars being interchangeable with spacer bars of different lengths so that the width of said cassette may be varied to accommodate bookbinding strips having different lengths, each said spacer bar having first connector means on each end thereof and each said side rail having second connector means to engage said first connector means in order to secure said spacer bars to said side rails at the level of said side rails.

* * * * *